US008459633B2

(12) United States Patent
Lee

(10) Patent No.: US 8,459,633 B2
(45) Date of Patent: Jun. 11, 2013

(54) FINANCIAL DEVICE AND MEDIUM PROCESSING APPARATUS

(75) Inventor: Sumin Lee, Seoul (KR)

(73) Assignee: LG-CNS Co. Ltd., Seoul (KR)

( * ) Notice: Subject to any disclaimer, the term of this patent is extended or adjusted under 35 U.S.C. 154(b) by 0 days.

(21) Appl. No.: 13/191,894

(22) Filed: Jul. 27, 2011

(65) Prior Publication Data

US 2012/0025445 A1 Feb. 2, 2012

(30) Foreign Application Priority Data

Jul. 30, 2010 (KR) ..... 10-2010-0073886

(51) Int. Cl.
*B65H 85/00* (2006.01)
*B65H 5/00* (2006.01)

(52) U.S. Cl.
USPC ..... 271/3.08; 271/4.08; 271/10.04; 271/4.04; 271/314

(58) Field of Classification Search
USPC ..... 271/3.01, 3.08, 10.01, 10.04, 10.13, 271/4.01, 4.08, 4.04, 314
See application file for complete search history.

(56) References Cited

U.S. PATENT DOCUMENTS

| | | | | |
|---|---|---|---|---|
| 7,243,914 | B2 * | 7/2007 | Tokunaga et al. | 271/3.01 |
| 7,380,784 | B2 * | 6/2008 | Mizuno | 271/207 |
| 7,556,262 | B2 * | 7/2009 | Mizuno | 271/207 |
| 7,654,516 | B2 * | 2/2010 | Terao et al. | 271/119 |
| 7,722,024 | B2 * | 5/2010 | Jeong | 271/3.08 |
| 7,793,931 | B2 * | 9/2010 | Mizuno | 271/207 |
| 7,942,401 | B2 * | 5/2011 | Jeong | 271/3.08 |
| 2004/0135304 | A1 * | 7/2004 | Tokunaga et al. | 271/3.01 |
| 2005/0200073 | A1 * | 9/2005 | Mizuno | 271/207 |
| 2009/0236788 | A1 * | 9/2009 | Mizuno | 271/3.02 |

FOREIGN PATENT DOCUMENTS

KR 10-2009-0038988 A 4/2009

OTHER PUBLICATIONS

Office Action dated Aug. 29, 2011 in Korean Application No. 10-2010-0073886, filed Jul. 30, 2010.

* cited by examiner

*Primary Examiner* — Patrick Cicchino
(74) *Attorney, Agent, or Firm* — Saliwanchik, Lloyd & Eisenschenk

(57) ABSTRACT

Provided is a medium processing apparatus, which comprises a transfer roller unit and a guide roller unit. The transfer roller unit comprises a first rotation shaft and one or more transfer rollers coupled to the first rotation shaft. The guide roller unit receives power from the transfer roller unit, and comprises a second rotation shaft, a one-way clutch connected to the second rotation shaft, and a guide roller connected to the one-way clutch.

17 Claims, 5 Drawing Sheets

FINANCIAL DEVICE AND MEDIUM PROCESSING APPARATUS

CROSS-REFERENCE TO RELATED APPLICATION

This application claims the benefit under 35 U.S.C. §119 of Korean Patent Application No. 10-2010-0073886, filed on Jul. 30, 2010, which is hereby incorporated by reference in its entirety.

BACKGROUND

Embodiments relate to a financial device and a medium processing apparatus.

Generally, financial devices are devices that process a financial transaction a customer desires. The financial devices input/output a medium or automatically transfer the medium. The financial devices comprise a medium processing apparatus for processing a medium.

The medium processing apparatus comprises a plurality of guiders, a plurality of transfer rollers, and a plurality of guide rollers. When the transfer rollers rotate in a predetermined direction to introduce a medium, the guide rollers are at a stop. Thus, when a medium is introduced, a specific portion of the guide roller may be worn by friction between the medium and the guide rollers, thereby decreasing the service life of the guide roller.

BRIEF SUMMARY

Embodiments provide a financial device and a medium processing apparatus.

In one embodiment, a medium processing apparatus comprises: a transfer roller unit comprising a first rotation shaft and one or more transfer rollers coupled to the first rotation shaft; and a guide roller unit receiving power from the transfer roller unit and comprising a second rotation shaft, a one-way clutch connected to the second rotation shaft, and a guide roller connected to the one-way clutch.

In another embodiment, a financial device comprises: a medium entrance through which a medium is input and output; and a medium processing apparatus for processing the medium, wherein the medium processing apparatus comprises: a transfer roller unit comprising a first rotation shaft and one or more transfer rollers coupled to the first rotation shaft; and a guide roller unit comprising a second rotation shaft receiving power from the transfer roller unit, and a guide roller connected to the second rotation shaft to move relative to the second rotation shaft, wherein, when one or more of the transfer rollers rotate in a first direction, the second rotation shaft and the guide roller are at a stop, and when one or more of the transfer rollers rotate in a second direction, the guide roller and the second rotation shaft rotate in the first direction and are different in rotation speed.

The details of one or more embodiments are set forth in the accompanying drawings and the description below. Other features will be apparent from the description and drawings, and from the claims.

DETAILED DESCRIPTION

Figure 1:
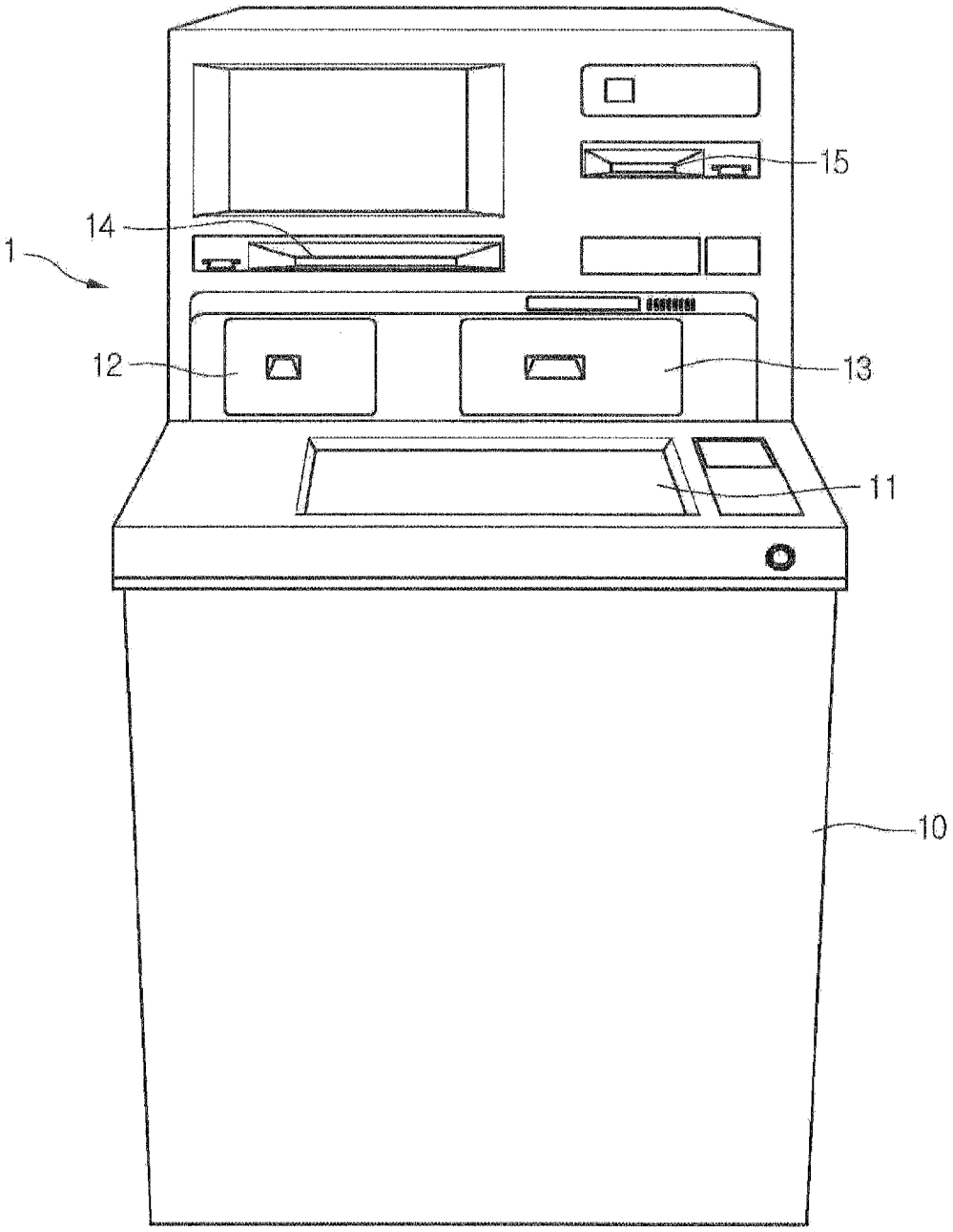
FIG. 1 is a perspective view illustrating a financial device according to an embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected", "coupled," and "joined" to the latter or "connected", "coupled", and "joined" to the latter via another component.

A financial device according to embodiments is a device that performs financial businesses, i.e., medium processing comprising processing such as deposit processing, giro receipt, or gift certificate exchange and/or processing such as withdrawal processing, giro dispensing, or gift certificate dispensing by receiving various medium such as, e.g., paper moneys, bills, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial businesses such as a financial information system (FIS).

Hereinafter, assuming that the financial device is the ATM, an embodiment will be described. However, this assumption is merely for convenience of description, and technical idea of the present disclosure is not limited to the ATM.

FIG. 1 is a perspective view illustrating a financial device according to an embodiment.

Referring to FIG. 1, a financial device 1 comprises a main body 10 that accommodates a number of parts. The main body 10 may comprise an input part 11 for a user to perform a financial process, a check entrance 12 through which a check is input and output, a paper money entrance 13 through which a paper money is input and output, a bankbook entrance 14 through which a bankbook is input and output, and a card entrance 15 through which a card is input and output. At least one of the check entrance 12, the bankbook entrance 14, and the card entrance 15 may be removed.

Since the financial device 1 may have a well-known structure, a description thereof will be omitted. The check entrance 12 and the paper money entrance 13 are referred to as a medium entrance herein.

A medium processing apparatus 20 (refer to FIG. 2) is disposed in the main body 10 to transfer a medium introduced through the medium entrance or to discharge a medium.

Figure 2:
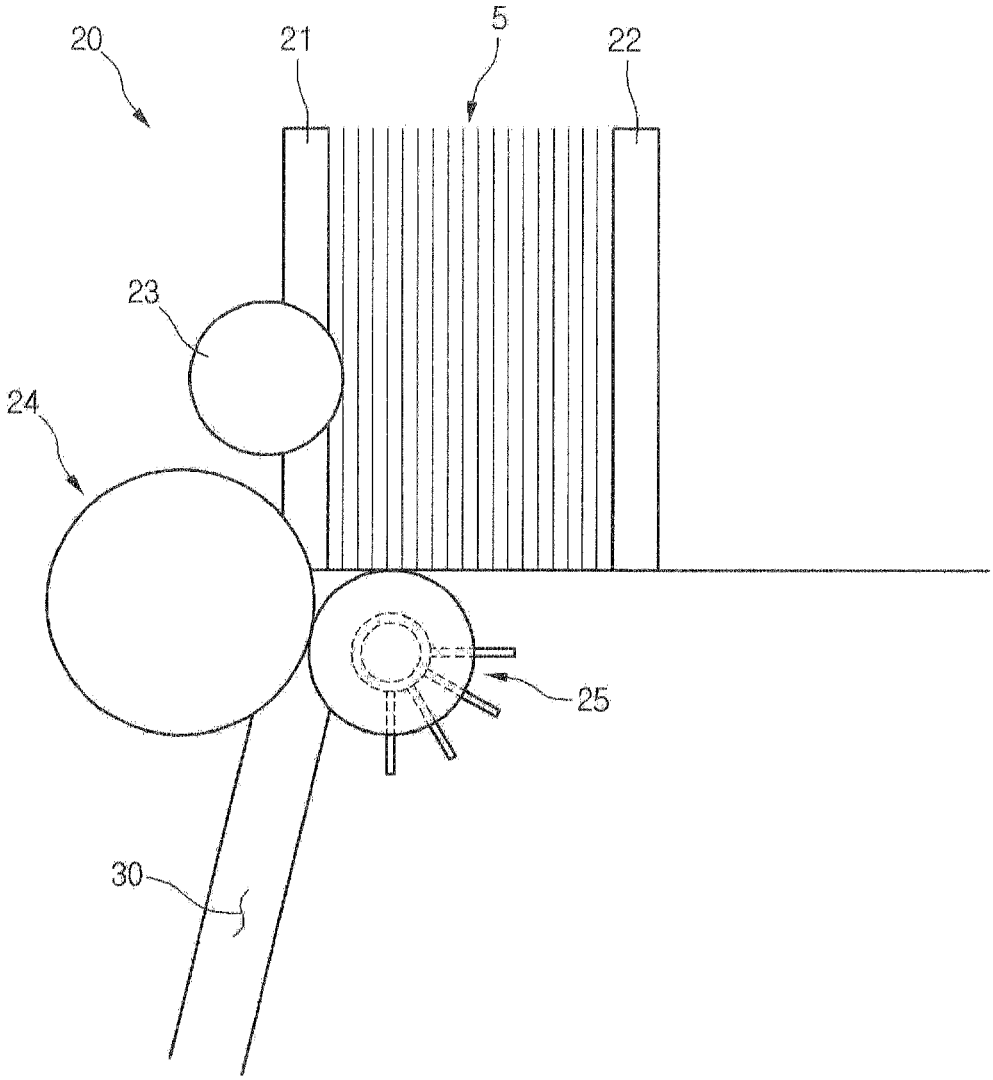
FIG. 2 is a schematic view illustrating a medium processing apparatus according to an embodiment.
Figure 3:
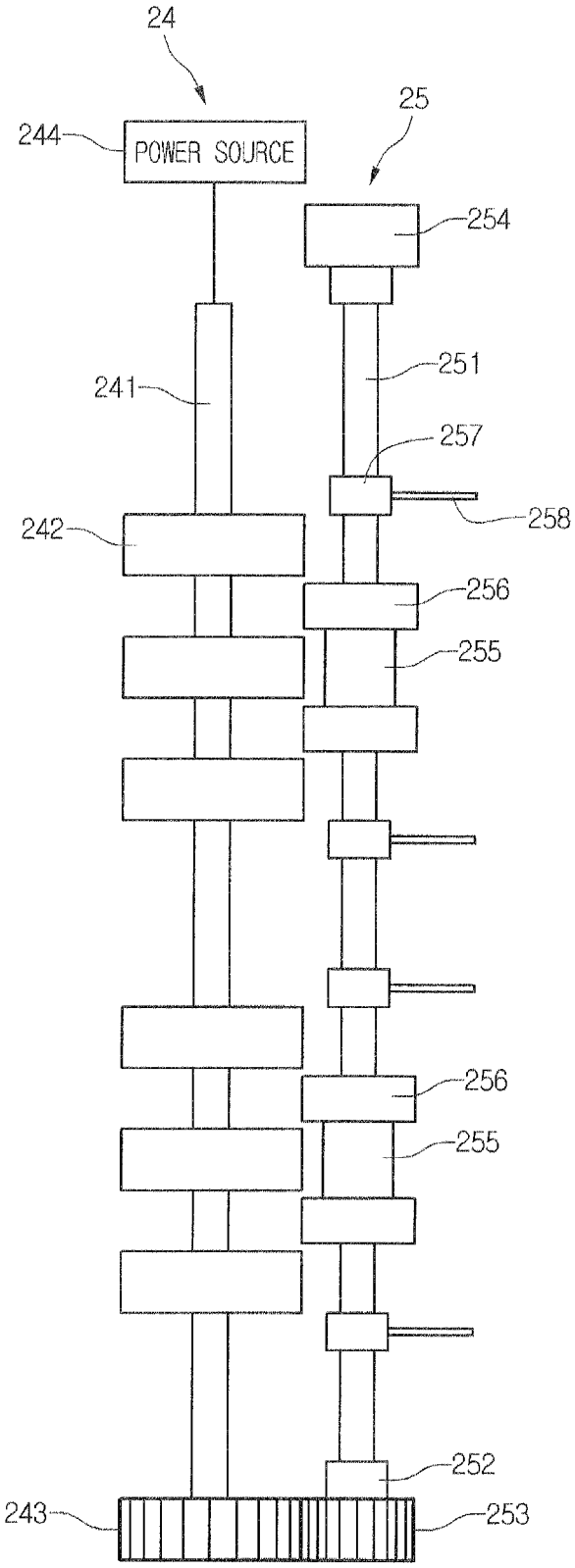
FIG. 3 is a plan view illustrating a transfer roller unit and a guide roller unit, which constitute the medium processing apparatus of FIG. 2.

FIG. 2 is a schematic view illustrating a medium processing apparatus according to an embodiment. FIG. 3 is a plan view illustrating a transfer roller unit and a guide roller unit, which constitute the medium processing apparatus of FIG. 2.

Referring to FIGS. 2 and 3, the medium processing apparatus 20 comprises: a passage 30 through which a medium is transferred; a separating roller 23 for separating one or more media from each other; a transfer roller unit 24 for transferring the separated medium through the passage 30; and a guide roller unit 25.

The medium processing apparatus 20 may further comprise a front guider 21 and a press 22 pressing a medium against the front guider 21.

The transfer roller unit 24 may comprise a first rotation shaft 241, one or more transfer rollers 242 coupled to the first rotation shaft 241, a power source 244 connected to an end of the first rotation shaft 241 to rotate the first rotation shaft 241, and a first gear 243 connected to the other end of the first rotation shaft 241. For example, the transfer rollers 242 may be disposed on the first rotation shaft 241 as illustrated in FIG. 3. The transfer rollers 242 are spaced apart from each other. The separating roller 23 may be rotated by a power source separated from the power source 244 for rotating the first rotation shaft 241. Alternatively, the separating roller 23 may be rotated by the power source 244.

The guide roller unit 25 may comprise a second rotation shaft 251, a first clutch 252 coupled to an end of the second rotation shaft 251, a second clutch 254 coupled to the other end of the second rotation shaft 251, one or more third clutches 255 (also called roller connecting clutches) coupled to the second rotation shaft 251 between the first and second clutches 252 and 254, a plurality of guide rollers 256 coupled to the third clutches 255, and a plurality of return rollers 257 coupled to the second rotation shaft 251.

Each of the clutches 252, 254, and 255 may be a one-way clutch. The one-way clutch transmits power in one direction only. The one-way clutch comprises an inner body, an outer body, and a plurality of rollers disposed between the inner body and the outer body. Since the one-way clutch may have a well-known structure, a description thereof will be omitted.

The outer body of the first clutch 252 as the one-way clutch is coupled to a second gear 253. The inner body of the first clutch 252 is coupled to the second rotation shaft 251. The second rotation shaft 251 may rotate together with the inner body of the first clutch 252. The second gear 253 engages with the first gear 243.

The inner body of the second clutch 254 as the one-way clutch is coupled to the second rotation shaft 251. The outer body of the second clutch 254 may be fixed to a frame (not shown) fixed in the main body 10. That is, the outer body of the second clutch 254 is immobilized.

The second clutch 254 with the outer body fixed to the frame, and the first clutch 252 connected through the second gear 253 to the transfer roller unit 24 limit a rotation direction of the second rotation shaft 251 to only the clockwise direction (a first direction) with respect to FIG. 2. That is, the second rotation shaft 251 is not allowed to rotate counterclockwise (in a second direction) with respect to FIG. 2, and is allowed to rotate clockwise together with the inner bodies or the first and second clutches 251 and 252. In detail, when the first gear 243 rotates clockwise, the second gear 253 and the outer body of the first clutch 252 rotate counterclockwise, but the inner body of the first clutch 252 does not rotate. Thus, the second rotation shaft 251 does not rotate either.

The inner bodies of the third clutches 255 as the one-way clutches are coupled to the second rotation shaft 251, and the outer bodies thereof are coupled to the guide rollers 256. Referring to FIG. 3, the guide roller 256 may be disposed between neighboring ones of the transfer rollers 242. The inner bodies of the third clutches 255 may rotate counterclockwise with respect to FIG. 2, together with the outer bodies of the third clutches 255. When the inner bodies of the third clutches 255 rotate clockwise, (at this point, the second rotation shaft 251 rotates clockwise), the outer bodies of the third clutches 255 move relative to the inner bodies thereof. That is, when the inner bodies of the third clutches 255 rotate clockwise, the outer bodies of the third clutches 255 are at a stop as long as external force is not applied.

Since the second rotation shaft 251 does not rotate counterclockwise as described above, the outer bodies of the third clutches 255 cannot rotate counterclockwise. Thus, the guide rollers 256 cannot rotate counterclockwise either.

The return roller 257 comprises one or more contacts 258. Referring to FIG. 2, the return roller 257 comprises a plurality of the contacts 258. The contacts 258 extend radially from an outer circumferential surface of the return roller 257.

The contacts 258 are spaced apart from one another within a certain angle, e.g., about 90° along the outer circumferential surface of the return roller 257. While media 5 are introduced, the contacts 258 are disposed at a position illustrated in FIG. 2, to prevent an interference between the contact 258 and the medium 5. That is, the contacts 258 are disposed out of the passage 30. Since the return rollers 257 are coupled to the second rotation shaft 251, the return rollers 257 rotate together with the second rotation shaft 251.

When return of the medium 5 is completed, the contacts 258 returns to their original position, i.e., the position illustrated in FIG. 2. To this end, the media processing apparatus 20 may comprise a sensor (not shown) such as an encoder for sensing rotation of the contacts 258.

Introduction and return of a medium will now be described.

Figure 4:
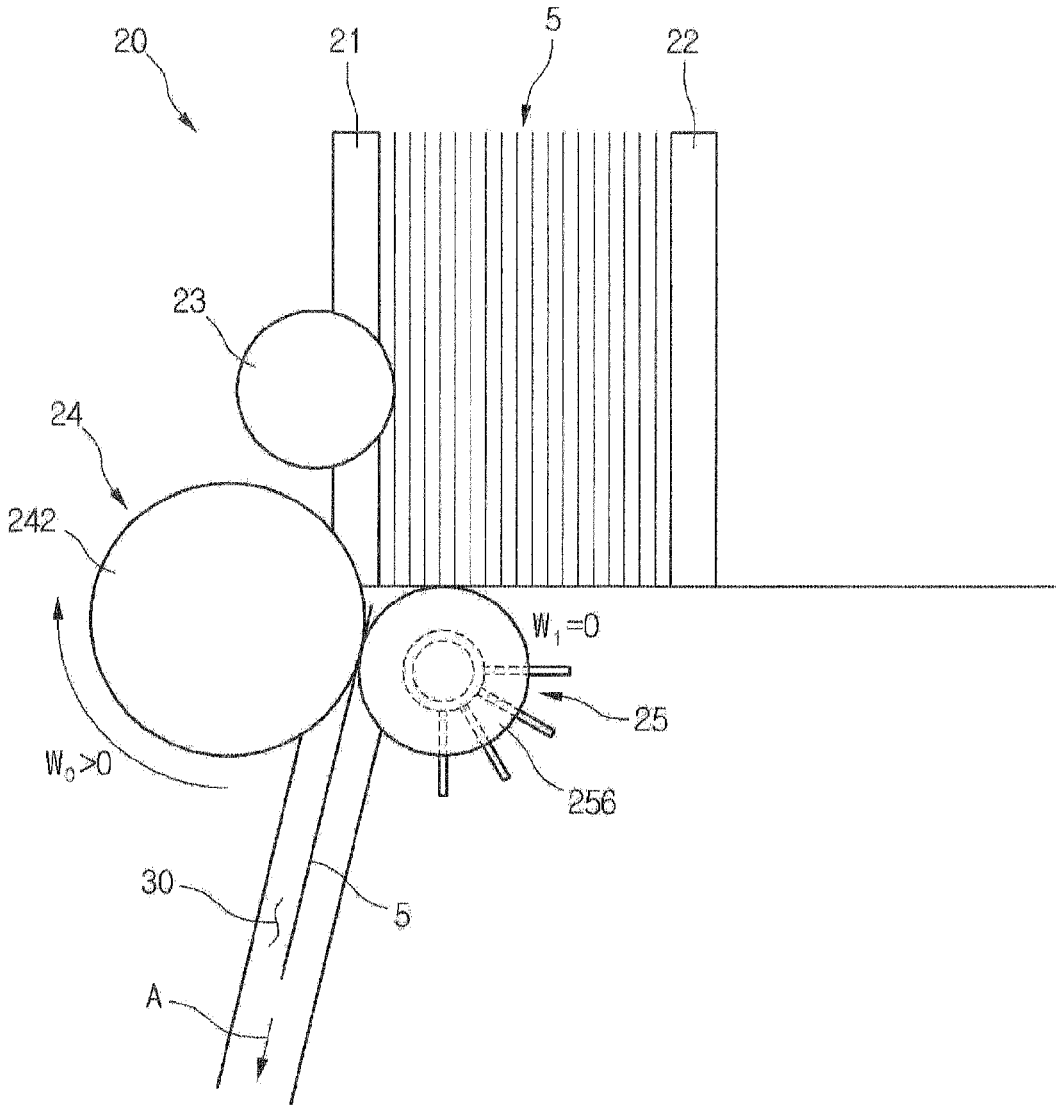
FIG. 4 is a schematic view illustrating an operation of a medium processing apparatus when a medium is introduced, according to an embodiment.
Figure 5:
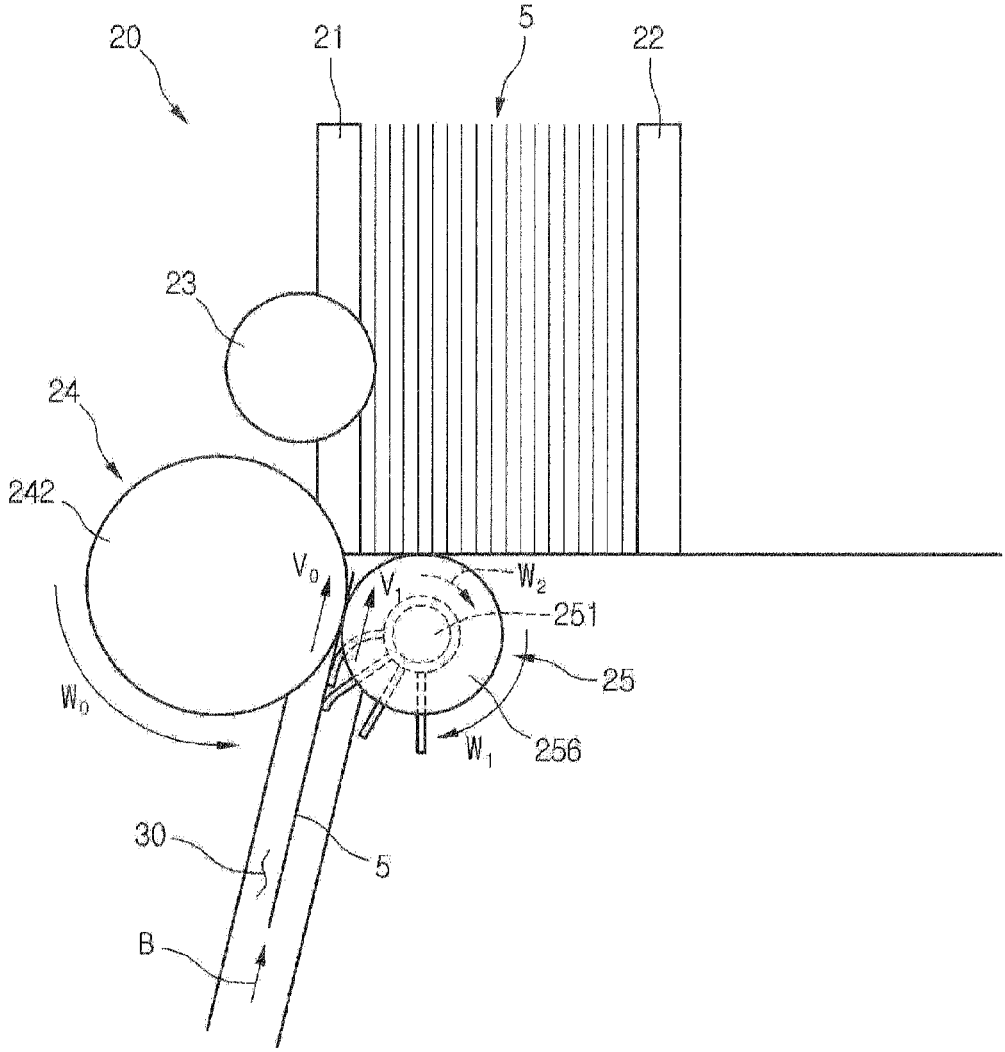
FIG. 5 is a schematic view illustrating an operation of a medium processing apparatus when a medium is returned, according to an embodiment.

FIG. 4 is a schematic view illustrating an operation of a medium processing apparatus when a medium is introduced, according to an embodiment. FIG. 5 is a schematic view illustrating an operation of a medium processing apparatus when a medium is returned, according to an embodiment.

Referring to FIGS. 2 to 4, the separating roller 23 and the transfer rollers 242 rotate clockwise to introduce the medium 5. Meanwhile, the guide rollers 256 are at a stop. That is, an absolute value of an angular velocity $W_0$ of the transfer rollers 242 is greater than zero, and an absolute value of an angular velocity $W_1$ of the guide rollers 256 is zero. Then, the separating roller 23 and the transfer rollers 242 transfer the medium 5 in an arrow direction A between a plurality of the transfer rollers 242 and a plurality of the guide rollers 256. At this point, since the guide rollers 256 are at a stop, friction is generated between the medium 5 and the guide rollers 256.

On the contrary, referring to FIG. 5, when the medium 5 is returned, the first rotation shaft 241 and the transfer rollers 242 rotate counterclockwise. Then, the second gear 253 and the second rotation shaft 251 having an angular velocity of $W_2$ rotate clockwise, and the medium 5 is transferred in an arrow direction B.

While the medium 5 is transferred in the arrow direction B, the return rollers 257 also rotate clockwise, and the contacts 258 sequentially contact the medium 5. Accordingly, the medium 5 can be efficiently transferred upward by the contacts 258, thereby facilitating the return of the medium 5.

If the second rotation shaft 251 rotates clockwise with absent external force applied to the guide rollers 256, the guide rollers 256 are not moved. However, friction force generated between the guide rollers 256 and the medium 5 moving in the arrow direction B rotates the guide rollers 256 having the angular velocity $W_1$ clockwise.

When the medium 5 passes between a plurality of the transfer rollers 242 and a plurality of the guide rollers 256, a linear velocity $V_0$ of the transfer rollers 242 is higher than a linear velocity $V_1$ of the guide rollers 256. The linear velocities $V_0$ and $V_1$ may be varied according to a ratio of the first gear 243 to the second gear 253. A ratio of the first gear 243 to the second gear 253 is determined by a number of experiments such that the linear velocity $V_0$ of the transfer rollers 242 is higher than the linear velocity $V_1$ of the guide rollers 256. Thus, an absolute value of the angular velocity $W_2$ of the second rotation shaft 251 is greater than that of the angular velocity $W_1$ of the guide rollers 256.

When the angular velocity $W_2$ of the second rotation shaft 251 is different from the angular velocity $W_1$ of the guide rollers 256, the guide rollers 256 move relative to the second rotation shaft 251, and thus, the position of a frictional surface of the guide rollers 256 contacting the medium 5 may be varied. That is, a rotation speed of the second rotation shaft 251 is different from that of the guide rollers 256.

The second rotation shaft 251 is stopped at a predetermined position to return the return rollers 257 to their original position. If the angular velocity $W_2$ of the second rotation shaft 251 is the same as the angular velocity $W_1$ of the guide rollers 256, the guide rollers 256 are stopped at a predetermined position after returning the medium 5. In this case, the position of a frictional surface of the guide rollers 256 contacting the medium 5 is fixed.

However, according to the current embodiment, since the angular velocity $W_2$ of the second rotation shaft 251 is different from the angular velocity $W_1$ of the guide rollers 256, even though the second rotation shaft 251 returns to a predetermined position, a relative position of the guide rollers 256 to the second rotation shaft 251 can be varied. Accordingly, the position of a frictional surface of the guide rollers 256 contacting the medium 5 is varied, thereby extending the service life of the guide rollers 256.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or comprises or has) some elements, it should be understood that it may comprise (or comprise or has) only those elements, or it may comprise (or comprise or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A medium processing apparatus comprising:

a transfer roller unit comprising a first rotation shaft and one or more transfer rollers coupled to the first rotation shaft; and a guide roller unit receiving power from the transfer roller unit and comprising a second rotation shaft, a one-way clutch connected to the second rotation shaft, and a guide roller connected to the one-way clutch;

wherein the one-way clutch comprises an inter body and an outer body moving relative to the inner body;

wherein the inner body is connected to the second rotation shaft, and the outer body is connected to the glide roller;

wherein a side of the second rotation shaft is connected to a first clutch, and the other side second rotation shaft is connected to a second clutch;

wherein the first clutch comprises an outer body connected to the transfer roller unit, and an inner connected to the second rotation shaft; and wherein the second clutch comprises an outer body fixed to an immobilized frame, and an inner body connected to the second rotation shaft.

2. The medium processing apparatus of claim 1, further comprising a return roller on the second rotation shaft to guide return of a medium, wherein the return roller comprises one or more contacts that radially extend from the return roller.

3. The medium processing apparatus of claim 1, wherein when the transfer roller rotates in a first direction to introduce a medium, the guide roller and the second rotation shaft are at a stop, and when the transfer roller rotates in a second direction to return the medium, the guide roller and the second rotation shaft rotate in the first direction.

4. A medium processing apparatus comprising:

a transfer roller unit comprising a first rotation shaft and one or more transfer rollers coupled to the first rotation shaft; and a guide roller unit receiving power from the transfer roller unit and comprising a second rotation shaft, a one-way clutch connected to the second rotation shall, and a guide roller connected to the one-way clutch;

wherein, when the transfer roller rotates in a first direction to introduce a medium, the guide roller and the second rotation shaft are at a stop, and when the transfer roller rotates in a second direction to return the medium, the guide roller and the second rotation shaft rotate in the first direction.

5. The medium processing apparatus of claim 4, wherein the second rotation shaft is rotated by the power transmitted from the transfer roller unit, and the guide roller is rotated by frictional force generated by transferring the media.

6. The medium processing apparatus of claim 4, wherein, when the second rotation shaft rotates, an absolute value of an angular velocity of the second rotation shaft is greater than an absolute value of an angular velocity of the guide roller.

7. The medium processing apparatus of claim 4, wherein the one-way clutch comprises an inner body and an outer body moving relative to the inner body, wherein the inner body is connected to the second rotation shaft, and the outer body is connected to the guide roller.

8. The medium processing apparatus of claim 7, wherein a side of the second rotation shaft is connected to a first clutch, and the other side of the second rotation shaft is connected to a second clutch;

wherein the first clutch comprises an outer body connected to the transfer roller unit, and an inner body connected to the second rotation shall; and wherein the second clutch comprises an outer body fixed to an immobilized frame, and an inner body connected to the second rotation shaft.

9. The medium processing apparatus of claim 4, further comprising a return roller on the second rotation shall to guide return of a medium, wherein the return roller comprises one or more contacts that radially extend from the return roller.

10. A financial device comprising:

a medium entrance through which a medium is input and output; and a medium processing apparatus for processing the medium, wherein the medium processing apparatus comprises:

a transfer roller unit comprising a first rotation shaft and one or more transfer rollers coupled to the first rotation shaft; and a guide roller unit comprising a second rotation shaft receiving power from the transfer roller unit, and a guide roller connected to the second rotation shaft to move relative to the second rotation shaft, wherein, when one or more of the transfer rollers rotate in a first direction, the second rotation shaft and the guide roller are at a stop, and when one or more of the transfer rollers rotate in a second direction, the guide roller and the second rotation shaft rotate in the first direction and are different in rotation speed.

11. The financial device of claim 10, further comprising a roller connecting clutch connecting the second rotation shaft to the guide roller, wherein the roller connecting clutch comprises a one-way clutch.

12. The financial device of claim 11, wherein the roller connecting clutch comprises an inner body and an outer body moving relative to the inner body, wherein the inner body is connected to the second rotation shaft, and the outer body is connected to the guide roller.

13. The financial device of claim 11, wherein a side of the second rotation shaft is connected to a first clutch, and the other side of the second rotation shaft is connected to a second clutch, wherein the first clutch comprises an outer body connected to the transfer roller unit, and an inner body connected to the second rotation shaft, and the second clutch comprises an outer body fixed to an immobilized frame, and an inner body connected to the second rotation shaft.

14. The financial device of claim 13, wherein the inner body and outer body of the first clutch rotate in the first direction when the transfer roller rotates in the second direction.

15. The financial device of claim 13, wherein the first clutch and the second clutch comprise a one-way clutch.

16. The financial device of claim 10, wherein, when the medium is introduced, the transfer roller rotates in the first direction, and when the medium is returned, the transfer roller rotates in the second direction.

17. The financial device of claim 10, further comprising a return roller on the second rotation shaft to guide return of the medium, wherein the return roller comprises one or more contacts that radially extend from the return roller.

* * * * *